US005154525A

United States Patent [19]

Matsuo

[11] Patent Number: 5,154,525

[45] Date of Patent: Oct. 13, 1992

[54] TOILET WATER APPLICATOR

[75] Inventor: Hideaki Matsuo, Tokyo, Japan

[73] Assignee: International Hashi, Inc., New York, N.Y.

[21] Appl. No.: 717,313

[22] Filed: Jun. 18, 1991

[30] Foreign Application Priority Data

Jun. 20, 1990 [JP] Japan ..... 2-163898

[51] Int. Cl.[5] ..... B43K 7/10

[52] U.S. Cl. ..... 401/209; 401/216; 401/219

[58] Field of Search ..... 401/209, 216, 219

[56] References Cited

U.S. PATENT DOCUMENTS

| | | | |
|---|---|---|---|
| 1,527,971 | 3/1925 | Forsell et al. | 401/216 |
| 3,259,935 | 7/1966 | Miller | 401/216 X |
| 4,770,558 | 9/1988 | Frietsch | 401/209 |

FOREIGN PATENT DOCUMENTS

| | | | |
|---|---|---|---|
| 2655264 | 6/1977 | Fed. Rep. of Germany | 401/216 |
| 3442331 | 5/1986 | Fed. Rep. of Germany | 401/209 |
| 2307667 | 12/1976 | France | 401/216 |
| 2462274 | 3/1981 | France | 401/209 |
| 464200 | 6/1951 | Italy | 401/209 |

*Primary Examiner*—Steven A. Bratlie

*Attorney, Agent, or Firm*—Brooks, Haidt, Haffner & Delahunty

[57] ABSTRACT

An applicator for toilet water or the like which has an internal capillary structure for delivering liquid from a liquid storage cavity to a dispensing ball. The capillary structure includes a multiplicity of chambers penetrated by a narrow groove for transporting liquid by capilliary action and a wider groove for carrying air to the liquid storage cavity to maintain equilibrium.

9 Claims, 4 Drawing Sheets

FIG. 7A
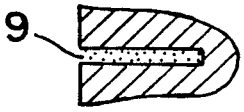
FIG. 7B
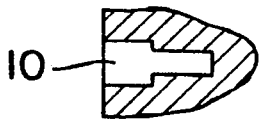
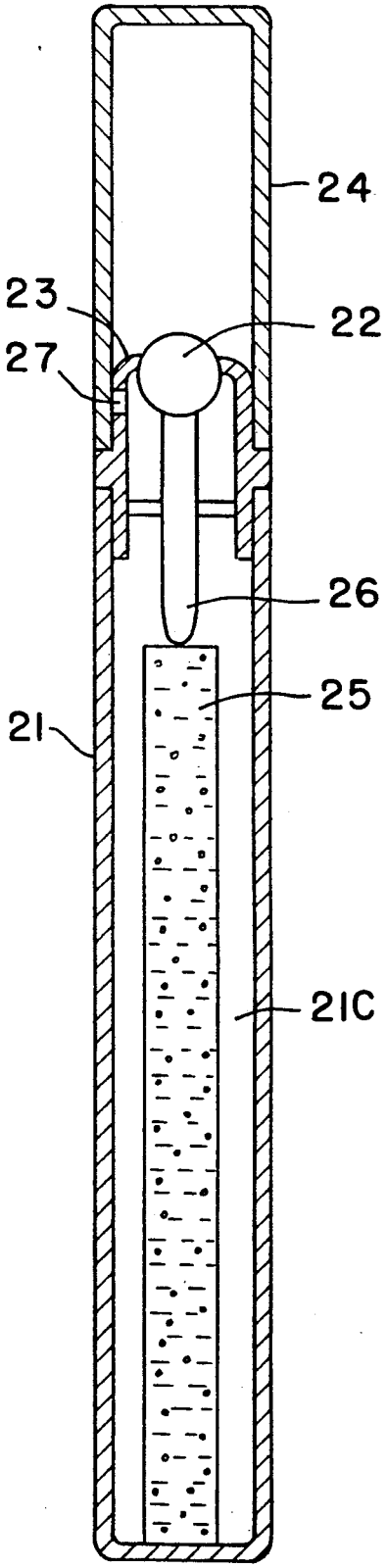
FIG. 8
PRIOR ART

TOILET WATER APPLICATOR

BACKGROUND OF THE INVENTION

1. Field of the Invention

The invention relates to the application of liquids, and more particularly to the application of liquids such as toilet water or perfume to the body.

2. Description of Related Art

When applying toilet water or perfume people ordinarily sprinkle the liquid through the mouth of a container or use some sort of spray device. Such containers and devices are inconvenient to carry and may dispense excessive amounts of liquid with consequent excessive odor.

A well known prior art applicator is illustrated in FIG. 8. In that drawing figure, a liquid-absorbent cotton-like medium 25 containing the perfume or other liquid to be dispensed is located in an internal cavity 21C of a generally cylindrical body 21. An intermediate elongated wick 26, which can be made of felt or the like, contacts both the cotton-like medium 25 and the rear face of a rotatable ball 22. In this prior art device, liquid such as perfume can be supplied little by little to the ball 22 from the cotton-like medium 25 via the wick 26. An opening 27 for admitting air is provided in a side of the applicator tip 23 which holds the ball.

The prior art device of FIG. 8 has certain drawbacks (a) As the amount of liquid stored decreases, the liquid supply to the ball becomes irregular in spite of the wick. Attempting to overcome this by storing a larger amount of liquid results in dispensing too much liquid, and when the stored quantity decreases, too little or no liquid is dispensed.

(b) Dropping the prior art applicator can cause the ball to fall out into the cap 24. Liquid will then leak and the ball 22, having fallen out into the cap 24, may be lost if the cap 24 is removed.

(c) The container is not refillable and must be disposed of after the liquid supply is exhausted.

(d) An opening in the side of the applicator tip 23 is aesthetically undesirable.

The present invention solves the problem of conveniently supplying the desired amount of perfume or other liquid upon demand, regardless of the quantity of liquid remaining in the container. The applicator of the invention has a freely-rotating ball which is held in place so that it cannot fall out should the applicator be dropped. The supply of perfume or other liquid can be readily refilled.

SUMMARY OF THE INVENTION

The applicator of the invention for dispensing toilet water, perfume or the like has a cylindrical body with one end open and the other end closed. There is a cylindrical cavity within the cylindrical body. A tip end of the cylindrical body holds a freely rotating ball and is covered by a removable cap. Behind a rear, interior, face of the ball there is a capillary structure which facilitates the smooth ascension of toilet water or the like, stored within the body, up to the ball.

The capillary structure within the cylindrical cavity comprises a multiplicity of generally disc-shaped plastic partitions which are arranged transversely across the cylindrical cavity perpendicular to the cylinder axis. Thee partitions are penetrated by grooves of two different kinds. A shallow, narrow groove serves to bring perfume or other liquid to the dispensing ball. A deep, wide groove serves to bring air down to the interior cavity from a small opening at the tip of the body.

The cap has an internal lip which covers the ball exactly or closely when the cap is in place.

There is a removable screw-fitted stopcock at the normally closed end of the cylindrical body for refilling the body cavity with perfume or other liquid to be dispensed.

The body and tip may suitably be manufactured of plastic and the ball may be made of metal, glass or plastic. The ball preferably has a diameter of approximately 3 to 6 mm. and it is held in place within a concavity at the tip of the body which concavity has a diameter that is slightly larger than the ball diameter.

The capillary structure within the internal cavity of the cylindrical body comprises a multiplicity of chambers separated by the plastic partitions which are penetrated by the two longitudinally extending grooves, one of which grooves is narrow and the other of which is wide.

The space between successive partitions, that is, the depth of each of the multiple chambers, is preferably similar to the width of the narrow groove. Therefore, the liquid enters the narrow groove continuously as a result of the liquid's surface tension, but liquid does not enter the wide groove. As a result air is free to pass down the wide groove. In other words, perfume or other liquid fills up all of the chambers and the narrow groove behind the back of the ball, and air is admitted into the cavity through the wide groove. Air pressure maintains an equilibrium between the tip of the dispenser and the interior cavity. Accordingly, liquid never leaks from the dispenser if the dispenser should be dropped when not in use.

Capillary action in the chambers and the narrow groove brings perfume or other liquid up to the dispensing ball. However, the amount of liquid in the narrow groove does not change despite the amount of liquid stored in the cavity, for the narrow groove penetrates all of the chambers. Therefore the amount of perfume or other liquid available at the ball for application remains constant until the last chamber is exhausted of liquid.

Because of the interior lip or projection within the cap of the applicator, the ball cannot fall out of place even if the applicator is dropped or subjected to shock while the cap is in place, because the internal lip fits closely against or near the ball.

The screw fitted closure at the closed end of the applicator is removable so that the supply of liquid can be replenished, and the dispenser is thus re-usable, which is ecologically desirable.

BRIEF DESCRIPTION OF THE DRAWINGS

In the several figures, in which like reference characters indicate like parts throughout:

FIGS. 7(*a*) and 7(*b*) are detail views showing the relationship between liquid to be dispensed and the groove dimensions.

FIG. 8 is an illustration of a prior art applicator device.

DESCRIPTION OF A PREFERRED EMBODIMENT

Figure 1:
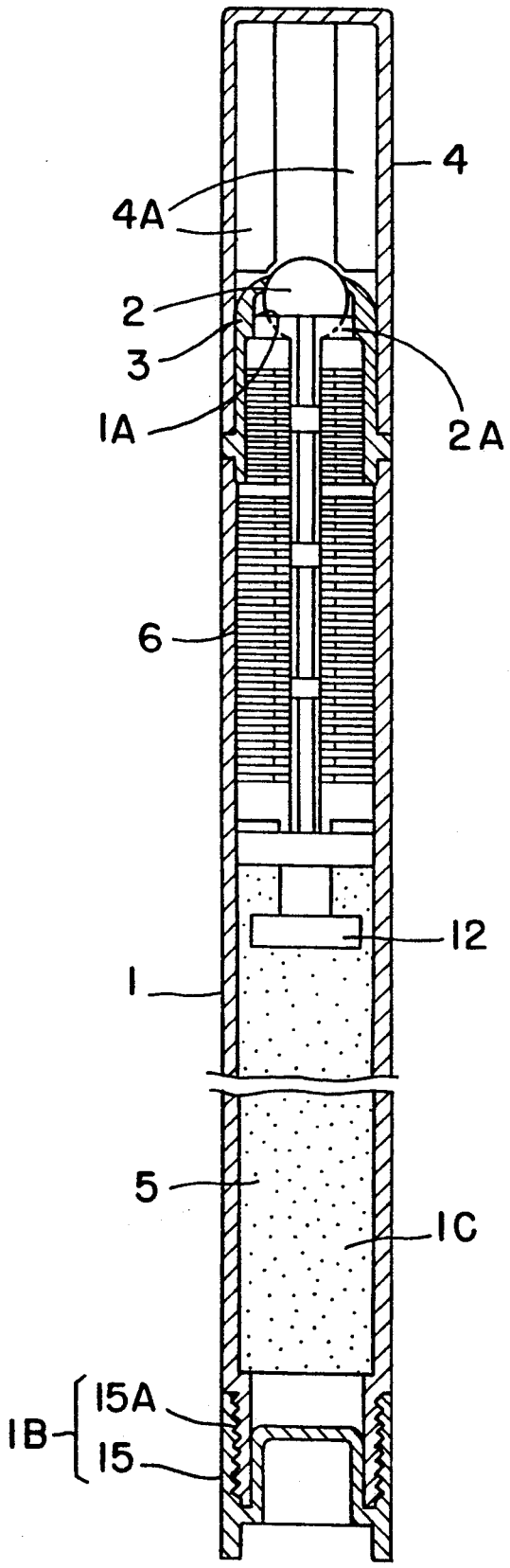
FIG. 1 is a view in vertical section of a preferred embodiment of the applicator of the invention.
Figure 2:
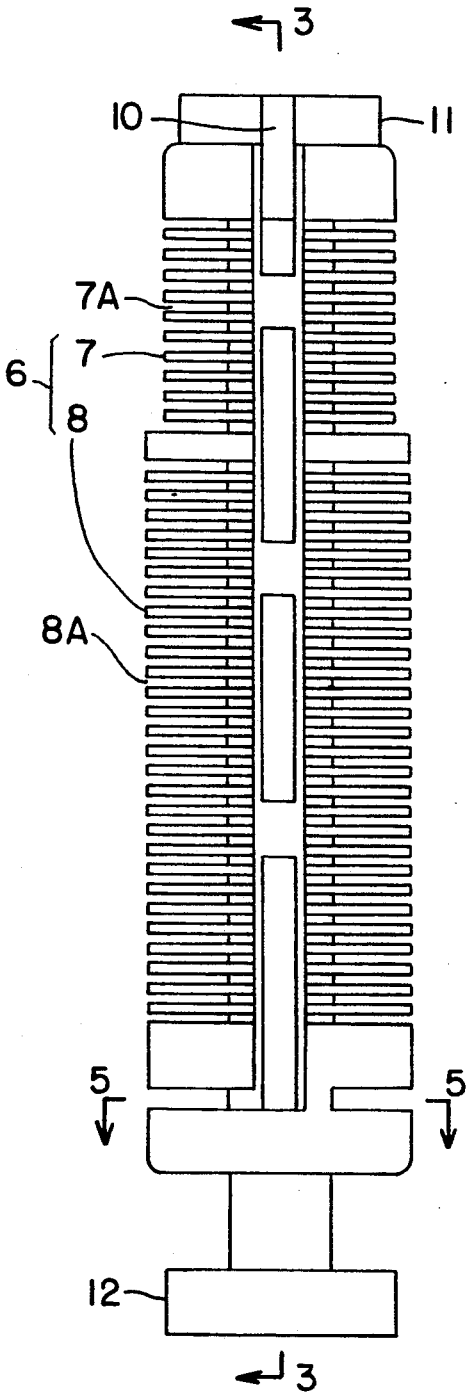
FIG. 2 is a side view of the internal structure of the applicator showing the capillary structure.

FIGS. 1 and 2 show a vertical section and internal detail views respectively of the applicator of the invention in a presently preferred embodiment. The open, or working end of the device is designated by the reference character 1A and the normally closed end i shown at 1B. The body 1 encloses the cylindrical cavity 1C. FIG. 1 shows the tip 3 inserted into the open end of the device at 1A and holding the freely rotating ball 2. A removable cap 4 covers the open end of the device and tip 3 of the body 1. The tip 3 is equipped with a capillary structure shown at 6 in FIG. 2 which occupies the space between the rear face 2A of the ball 2 and the cavity 1C. Capillary action serves to bring perfume or other liquid stored at 5 within the cavity 1C, up to the ball 2.

Figure 4:
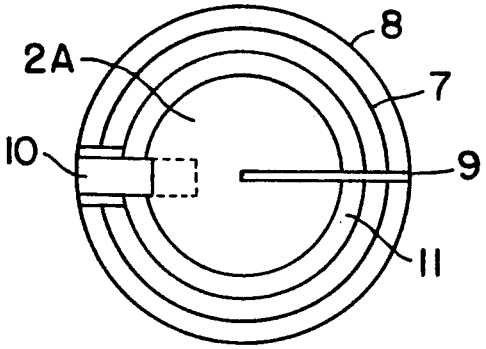
FIG. 4 is a cross-sectional view taken along line C—C of FIG. 3.

As shown in FIG. 2, the capillary structure 6 comprises a multiplicity of spaced flanges 7 and 8 which extend perpendicularly from a central axially extending body 13. The flanges 7 and 8 divide the zone between the rear face 2A of the ball 2 and the liquid reservoir at 1C into numerous generally toroidal chambers 7A, 8A. The two different grooves 9 and 10 penetrate the flanges 7 and 8 as well as the chambers 7A and 8A. The narrow, shallow groove 9, as shown in FIG. 4, brings perfume or other liquid up to the rear face 2A of the ball 2, and the deep, wide groove 10 brings air from the small opening 10A (see FIG. 6) at the tip 1A down into the liquid storage cavity 1C. Moreover, as shown in FIG. 1, a projection 4A provided within the cap 4 which covers the tip 3 fits closely or exactly over the ball 2 and prevents the ball 2 from coming out of place in the tip 3 in case of shock such as that caused by dropping the applicator.

The closed end 1B of the body 1 comprises an externally threaded area 15A on which an internally threaded cover 15 is fitted. By removing the cover 15, one can refill the cavity 1C with liquid, so the device is reusable and need not be thrown away when its supply of perfume or the like is exhausted.

Preferably the diameters of the ball 2 and the socket 11 therefor are about 5.5 mm. and 5.8 mm. respectively. The tip 3 of the dispenser holds the ball 2 firmly within the socket 11 as shown in FIG. 1. This structure is well adapted to application of perfume or the like.

Figure 6:
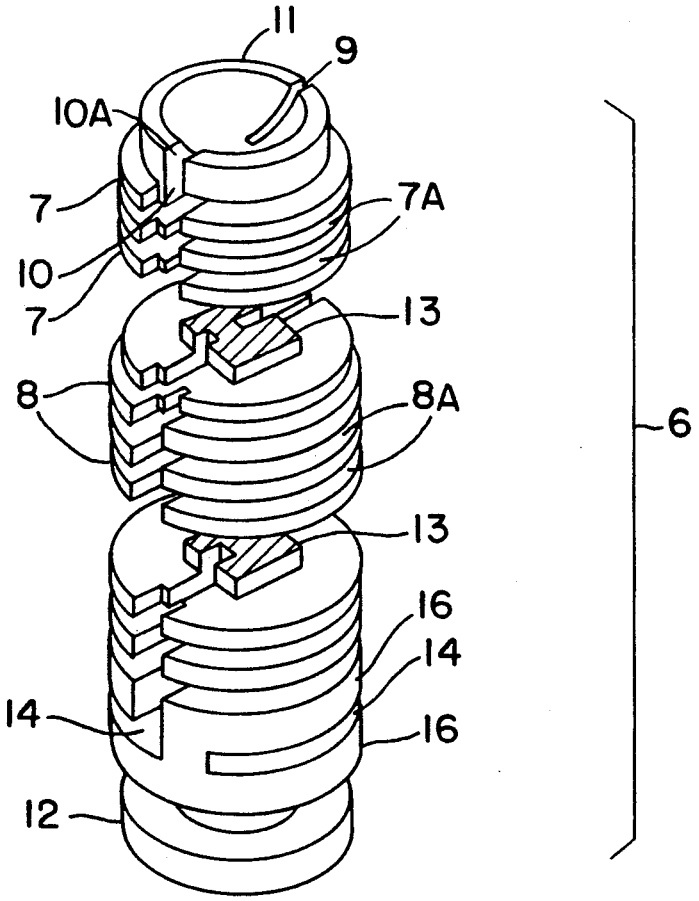
FIG. 6 is a partial view, in perspective of the capillary device which fits within the cylindrical body of the applicator of the invention.

The partial perspective view of FIG. 6 shows the details of the capillary structure 6, in which some portions have been omitted to show details more clearly.

The tip 3 of the capillary structure is equipped with a ball stand or socket 11 for snugly but rotatably holding the ball 2, with the rear face 2A of the ball fitted within the concavity of the socket 11. The socket 11 preferably has a diameter of about 5.8 mm. At the end of the structure 6 remote from the socket 11 is a circumferentially extending flange 12 which is fitted within the cavity 1C of the body 1 as shown in FIG. 1.

Figure 3:
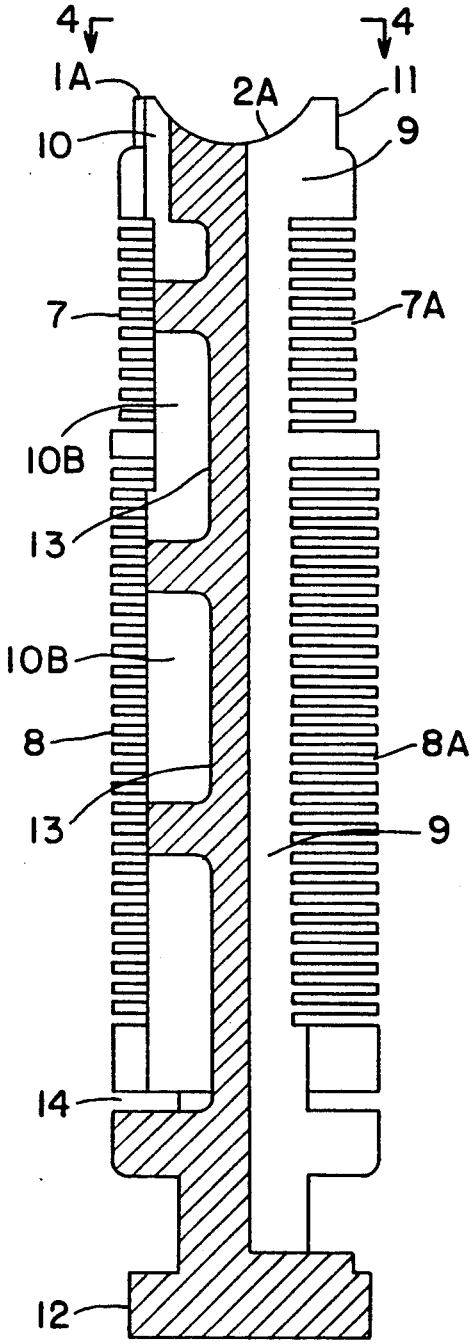
FIG. 3 is a view in cross-section taken along line B—B of FIG. 2.
Figure 5:
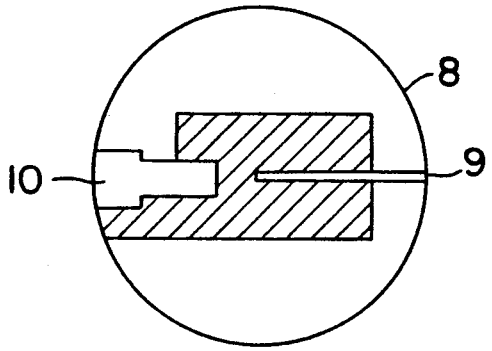
FIG. 5 is a sectional view taken along line D—D of FIG. 2.

Extending radially outward from a central axial member 13 are a multiplicity of flanges 7 and 8, the flanges 8 being shown as having a somewhat larger circumference than the flanges 7. Between adjacent flanges 7 are chambers 7A and between adjacent flanges 8 are chambers 8A. The narrow longitudinal groove 9 runs from the socket 11 down to an upper face of the flange 12 as shown in FIG. 3. This groove 9 extends inwardly through the successive flanges 7 and 8 and to about the central axis of the structure 6 as shown in FIGS. 3, 4 and 5. The narrow groove 9 penetrates essentially the entire structure 6, from a small opening 10A which is open to the ambient down to the flange 12. As seen in FIGS. 2–6 there is a pair of further flanges 16 spaced from and somewhat larger in circumference than the flange 12. A notch or groove 14 is defined between the flanges 16 and this notch or groove 14 extends almost completely around the central axial body 13. The narrow groove 9 preferably has a width of about 0.3 mm. The wider groove 10 has a width of about 1.0 to 1.5 mm. The flanges 7 and 8 and the chambers 7A and 8A all preferably have a thickness (in the axial direction with respect to the structure 6) of about 0.3 mm. That is, the narrow (width) dimension of the groove 9 is similar to the narrow (height) dimensions of the flanges 7, 8 and chambers 7A, 8A.

Accordingly, perfume or other liquid stored in the cavity 1C travels up the narrow groove 9 into the chambers 8A and 7A, but because of the liquid's surface tension, the liquid does not enter the wide groove 10. Air enters the wide groove 10 by way of the small opening 1A located near the ball 2, and passing through air chambers 10B (seen best in FIG. 3) reaches the notch 14. Thus the air pressure is maintained in equilibrium.

Since the wide groove 10 penetrates the flanges 7 and 8 and is open to the chambers 7A and 8A, air and perfume which enter the chambers 7A and 8A will come into contact with each other, but will not intermix because of the surface tension of the perfume in the narrow chambers.

Since air pressure is maintained at an equilibrium by means of the wide groove 10, perfume or other liquid continuously moves up the narrow groove into the chambers 8A and 7A as a result of capillarity and finally reaches the rear face 2A of the ball 2. Since the small dimensions of the chambers 7A and 8A and the groove 9 are the same or Similar, the effect of the capillary phenomenon is all but uniform. As perfume or other liquid is dispensed by means of the ball 2, the amount of liquid in the cavity decreases, to the point at which the storage cavity 1C is exhausted of liquid, at which time the cavity 1C is completely filled with air that has entered through the wide groove. As perfume or other liquid continues to be dispensed, the liquid supply is first extended in the chamber 8A nearest the cavity 1C and then in chambers 8A and then 7A successively further from the cavity and thus successively closer to the ball 2. Air fills each successive chamber 8A and then 7A as they become emptied of liquid. Thus air fills one chamber after another. Since each chamber plays the role of a vacuum condenser in a fluid tube, the amount of liquid supplied to the ball 2 stays the same, regardless of the amount of perfume or other liquid remaining, so long as the chamber 7A nearest the ball 2 is saturated. Thus the amount of perfume or other liquid to be applied remains constant until the liquid supply is almost totally exhausted.

The capillary structure has the advantage over cotton-like media of some prior art devices that it does not harbor bacteria. The ball 2 does not fall out because it is retained against shock by the internal projection 4A in the cap 4. Another advantage is that the applicator can be refilled by removal of the threaded cover 15, so it is environmentally superior to disposable devices.

In a preferred embodiment of the invention, the applicator is about 14 cm. long and 1 cm. in diameter. The capacity of the cavity 1C is preferably about 3 cubic centimeters and thus takes about 0.1 ounce of perfume or the like.

What is claimed is:

1. An applicator for liquid such as toilet water or the like, comprising: a generally cylindrical body defining a cylindrical cavity for holding a supply of liquid; a spherical ball mounted for rotation in a concave socket at one end of the body for dispensing liquid; a capillary structure within said body for smoothly transferring liquid from the cavity to a rear face of the ball, said capillary structure comprising a central axial member and a plurality of flanges formed integrally with and extending radially outward from said central axial member to define a plurality of generally toroidal chambers between successive ones said flanges; said flanges comprising two groups of flanges having mutually different radii, one group of flanges arranged nearer said ball having a uniform radius which is smaller than the uniform radius of flanges of another group of flanges arranged further from said ball to accommodate a removable cap placed on the applicator and covering said ball, the chambers between said flanges all having the same width in the axial direction of the applicator; and at least two mutually parallel grooves penetrating all of said flanges, one of said grooves being of narrow width essentially equal to the width of said chambers in the axial direction to assure capillary flow of liquid from said chambers to said one groove to thereby bring liquid from said cavity to said ball by capillary action and another of said grooves having a width greater than the width of said one groove for bringing air to said cavity from an opening near said ball.

2. The applicator of claim 1 wherein said cap has an internal stop for preventing dislodgement of said ball.

3. The applicator of claim 1 and having a removable cover at an end of said body remote from said ball for refilling said cavity.

4. The applicator of claim 1 wherein the body and flanges are formed of plastic material.

5. The applicator of claim 1 wherein said at least two grooves extend through said flanges and into said central axial member.

6. The applicator of claim 1 wherein said flanges extend into contact with an inner wall of said generally cylindrical body except at said at least two grooves.

7. The applicator of claim 1 wherein said one groove has a width of about 0.3 mm. and said other groove has a width of about 1.0 to 1.5 mm.

8. The applicator of claim 1 wherein, at an end of said central axial member remote from said ball, there is a circumferentially extending end flange integrally formed with said central axial member which is fitted within said cavity.

9. The applicator of claim 8 and including a pair of further spaced flanges on said central axial member spaced from and somewhat larger in diameter than said end flange, said pair of further flanges defining a notch which extends almost completely around the central axial body.

* * * * *

UNITED STATES PATENT AND TRADEMARK OFFICE

CERTIFICATE OF CORRECTION

PATENT NO. : 5,154,525

DATED : October 13, 1992

INVENTOR(S) : Hideaki Matsuo

It is certified that error appears in the above-identified patent and that said Letters Patent is hereby corrected as shown below:

Column 2, line 5, "a removable screw-fitted" should read:

--a removable, screw-fitted--.

Column 3, line 1, "in perspective of" should read:

--in perspective, of--.

line 16, "closed end i shown" should read:

--closed end is shown--.

Signed and Sealed this

Twenty-eighth Day of September, 1993

Bruce Lehman

*Attest:*

BRUCE LEHMAN

*Attesting Officer*

*Commissioner of Patents and Trademarks*